US007066148B2

(12) United States Patent
Nishiwaki

(10) Patent No.: US 7,066,148 B2
(45) Date of Patent: Jun. 27, 2006

(54) COMMON RAIL HAVING SKEW DELIVERY PORTS

(75) Inventor: Tadashi Nishiwaki, Kariya (JP)

(73) Assignee: Denso Corporation (JP)

( * ) Notice: Subject to any disclaimer, the term of this patent is extended or adjusted under 35 U.S.C. 154(b) by 0 days.

(21) Appl. No.: 10/924,772

(22) Filed: Aug. 25, 2004

(65) Prior Publication Data

US 2005/0098159 A1 May 12, 2005

(30) Foreign Application Priority Data

Nov. 7, 2003 (JP) ..... 2003-378955

(51) Int. Cl.
*F02M 37/04* (2006.01)

(52) U.S. Cl. ..... 123/456; 123/468

(58) Field of Classification Search ..... 123/468, 123/469, 470, 456, 467
See application file for complete search history.

(56) References Cited

U.S. PATENT DOCUMENTS 5,752,486 A * 5/1998 Nakashima et al. ..... 123/467
5,775,302 A * 7/1998 Guido et al. ..... 123/468
5,979,945 A * 11/1999 Hitachi et al. ..... 285/125.1
6,223,726 B1 * 5/2001 Jung et al. ..... 123/468
6,357,415 B1 * 3/2002 Mori ..... 123/198 DB
6,408,826 B1 * 6/2002 Asada et al. ..... 123/468
6,427,665 B1 * 8/2002 Knoedl et al. ..... 123/456
6,470,855 B1 * 10/2002 Frank et al. ..... 123/456
6,497,219 B1 12/2002 Natsume
6,637,407 B1 * 10/2003 Boecking ..... 123/456
2003/0141386 A1 7/2003 Wagner et al.

FOREIGN PATENT DOCUMENTS

WO WO 03/040547 A 5/2003

OTHER PUBLICATIONS

Patent Abstracts of Japan, vol. 1998, No. 11, Sep. 30, 1998, & JP 10 176783 A, Jun. 30, 1998.
Patent Abstracts of Japan, vol. 1998, No. 09, Jul. 31, 1998 & JP 10 110883 A, Apr. 28, 1998.
Patent Abstracts of Japan, vol. 1998, No. 11, Sep. 30, 1998 & JP 10 160079 A, Jun. 16, 1998.

* cited by examiner

*Primary Examiner*—Carl S. Miller
(74) *Attorney, Agent, or Firm*—Nixon & Vanderhye PC

(57) ABSTRACT

In a common rail for accumulating highly pressured fuel, a cylindrical body is provided with a chamber for accumulating highly pressured fuel and a delivery port which connects the chamber to the outer circumference thereof and communicates via a pipe-joining unit with a conduit in a distribution pipe. The longitudinal center axes of the chamber and the cylindrical body are disposed substantially coaxially with each other, and each of the longitudinal center axes of the delivery ports and the longitudinal center axis of the cylindrical body are skewed to each other. Accordingly, the durability of the cylindrical body is improved, and the thickness of the cylindrical body is uniform and the forging form of the cylindrical body becomes symmetric. The length of the delivery port is extended so that the durability of the cylindrical body is improved.

21 Claims, 5 Drawing Sheets

COMMON RAIL HAVING SKEW DELIVERY PORTS

CROSS REFERENCE TO RELATED APPLICATIONS

This application is based upon and claims the benefit of priority of Japanese Patent Application No. 2003-378955 filed on Nov. 7, 2003, the contents of which are incorporated herein by reference.

FIELD OF THE INVENTION

The present invention relates to a common rail for accumulating high-pressure fluid in a common rail type fuel injection system for engines.

BACKGROUND OF THE INVENTION

A common rail for accumulating highly pressured fuel for engines are constructed as shown in FIGS. 4 and 5.

In a common rail J1 shown in FIG. 4, a common rail housing is provided with a pressure accumulation chamber J2 in which highly pressured fuel is accumulated, and a plurality of fuel delivery ports J3 extending tangentially from the accumulation chamber J2. The longitudinal center axis D of the delivery ports J3 is positioned perpendicular to the longitudinal center axis B of the cylindrical body J4. The longitudinal center axis A of the pressure accumulation chamber J2 is offset by a given distance R against and in parallel with that B of the cylindrical body J4.

By offsetting the longitudinal center axis A of the pressure accumulation chamber J2 against that B of the cylindrical body J4, the internal opening of the delivery ports J3 is made oval and the circumferential length of the same is extended, so that the stress concentrated at the internal opening of the delivery ports J3 is reduced. This serves to improve the durability of the cylindrical body J4 against the accumulated pressure.

In a common rail J1 shown in FIG. 5, a common rail housing is made by forging and joint fitter J7 of a pipe joint body J5 (provided with a variable resistance valve J6) is formed in the same body with a cylindrical body J4. The longitudinal center axes A, B of a pressure accumulation chamber J2 and the cylindrical body J4 are positioned coaxially, and the longitudinal center axis D of a delivery port J3 is positioned a given distance R away from the longitudinal center axis B of the cylindrical body J4.

By offsetting the longitudinal center axes D of the delivery ports J3 against that B of the cylindrical body J4, the internal opening of the delivery ports J3 is made oval and the circumferential length whereof is extended, so that the stress concentrated at the internal opening of the delivery ports J3 is reduced.

Also by shaping a cross section of a pressure accumulation chamber oval, the internal opening of the delivery ports is made oval and the circumferential length whereof is extended, so that the stress concentrated at the internal opening of the delivery ports J3 is reduced. This common rail is disclosed in U.S. Pat. No. 6,497,219B2 (JP2001-295723).

These serves to improve the durability of the cylindrical body J4 against the accumulated pressure.

In the common rail J1 shown in FIG. 4, the pressure accumulation chamber J2 is positioned against the center axis B of the cylindrical body J4, so that the pressure accumulation chamber J2 cannot be formed by rotating the cylindrical body J4. Thus the processing method of the cylindrical body J4 is limited and the productivity of that is low.

The thickness of the cylindrical body J4 is not uniform. This may cause some distortion in the cylindrical body J4 by the heat caused by welding of the joint fitter J7 or the heat processing.

In the common rail J1 shown in FIG. 5, the position of the joint fitter J7 as well as that of the delivery port J3 is also offset against the longitudinal center axis of the cylindrical body J4. Thus, in manufacturing the cylindrical body J4, the die parting plane G is set on the longitudinal center axis D (line F) of the delivery port J3 which is offset a distance R away from the longitudinal center axis B of the cylindrical body J4. Thus, the die for forging the cylindrical body J4 is asymmetric and complex shape which causes the difficulty in making and shortens the life of the die.

The cylindrical body J4 endures tensile strength generated along the circumference thereof by the high-pressure fuel accumulated in the chamber J2. Accordingly, the tensile stress concentrates around the delivery port J3. That is, the durability of the cylindrical body J4 around the delivery port J3 is low.

SUMMARY OF THE INVENTION

An object of the present invention is to provide a common rail, in which a circumferential length of the internal opening of a delivery port is extended so that the durability of a cylindrical body is improved, and the thickness of the cylindrical body is uniform.

Another object of the present invention is to provide a common rail, in which the length of the delivery port is extended so that the durability of the cylindrical body is improved.

To achieve the above objects, a common rail according to the present invention has a cylindrical body provided with a chamber for accumulating highly pressured fuel and a delivery port which connects the chamber to the outer circumference thereof and communicate via a pipe-joining units with a conduit in distribution pipe. The longitudinal center axes of the chamber and the cylindrical body are disposed substantially coaxially with each other, and each of the longitudinal center axes of the delivery ports and the longitudinal center axis of the cylindrical body are in a skew relation. Thus, the delivery ports are skewed to the fluid passages of the pipe-joining units, respectively.

BRIEF DESCRIPTION OF THE DRAWINGS

Other features and advantages of the present invention will be appreciated, as well as methods of operation and the function of the related parts, from a study of the following detailed description, the appended claims, and the drawings, all of which form a part of this application. In the drawings:

DETAILED DESCRIPTION OF THE PREFERRED EMBODIMENTS

The first embodiment of the present invention is described with reference to FIGS. 1 to 3.

First Embodiment

Figure 2:
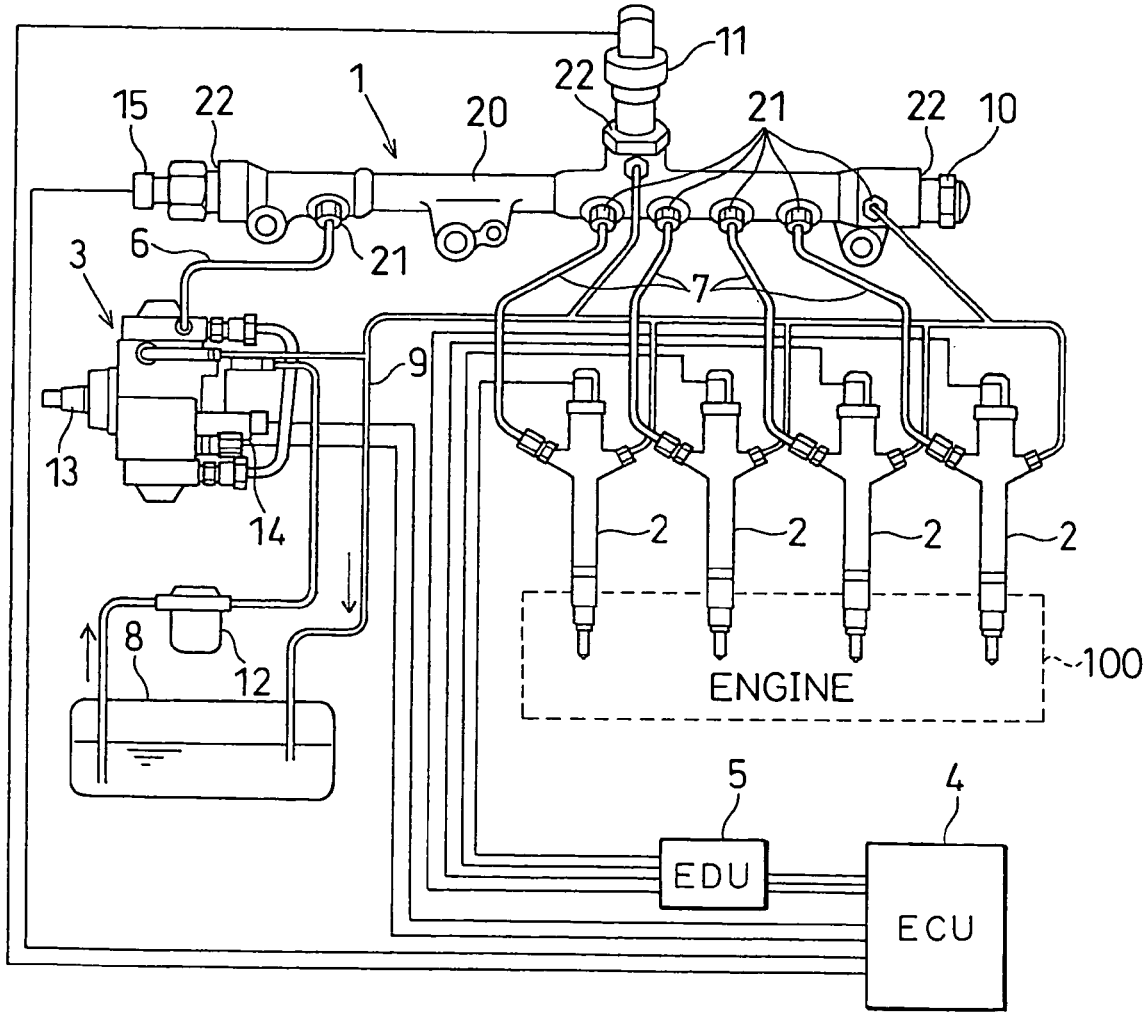
FIG. 2 is schematic view of a common rail type fuel injection system incorporating the common rail in accordance with the first embodiment.
Figure 3:
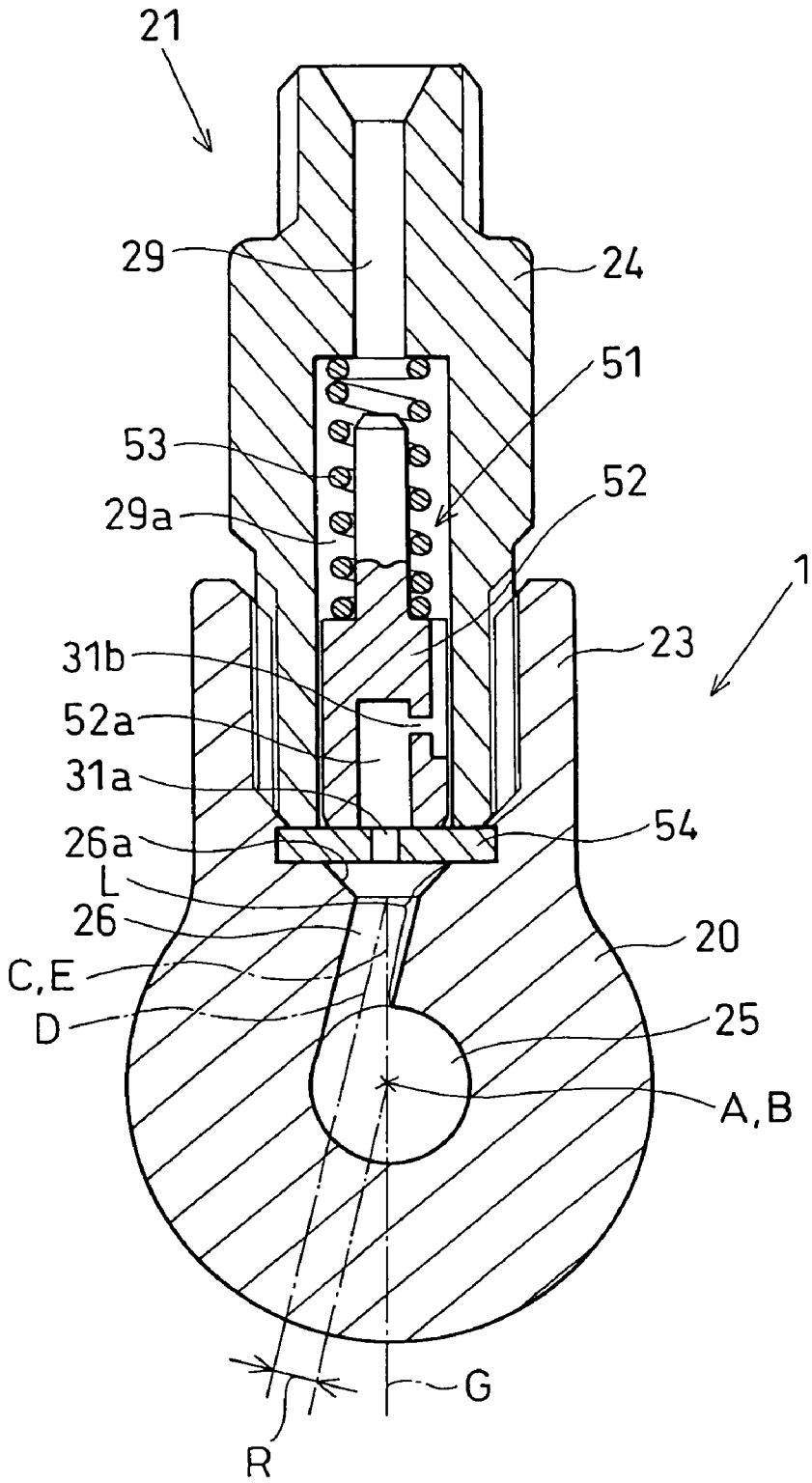
FIG. 3 is a cross sectional view of a common rail in accordance with the second embodiment of present invention.
Figure 4:
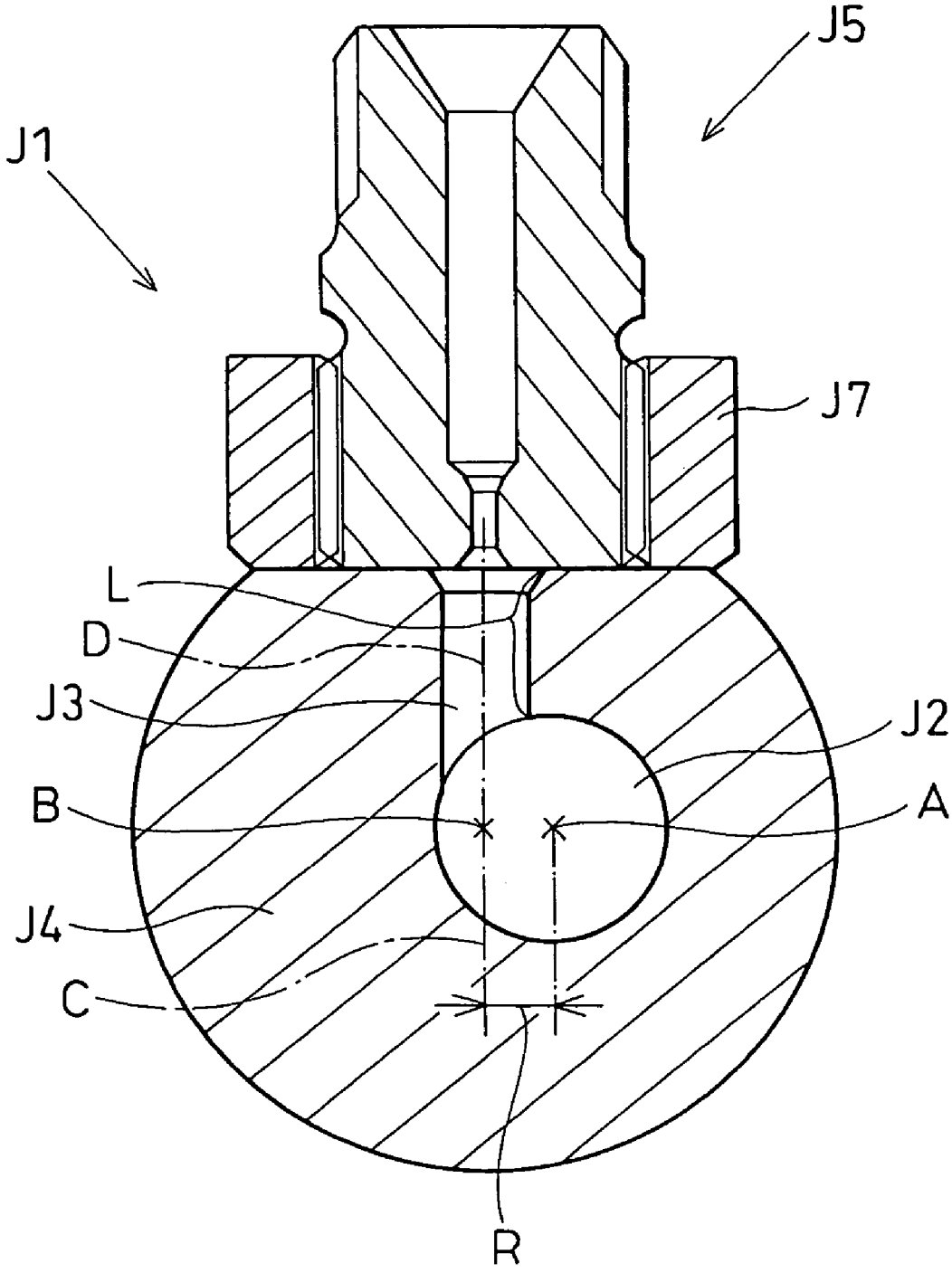
FIG. 4 PRIOR ART
FIG. 4 is a cross sectional view of a common rail in a prior art.
Figure 5:
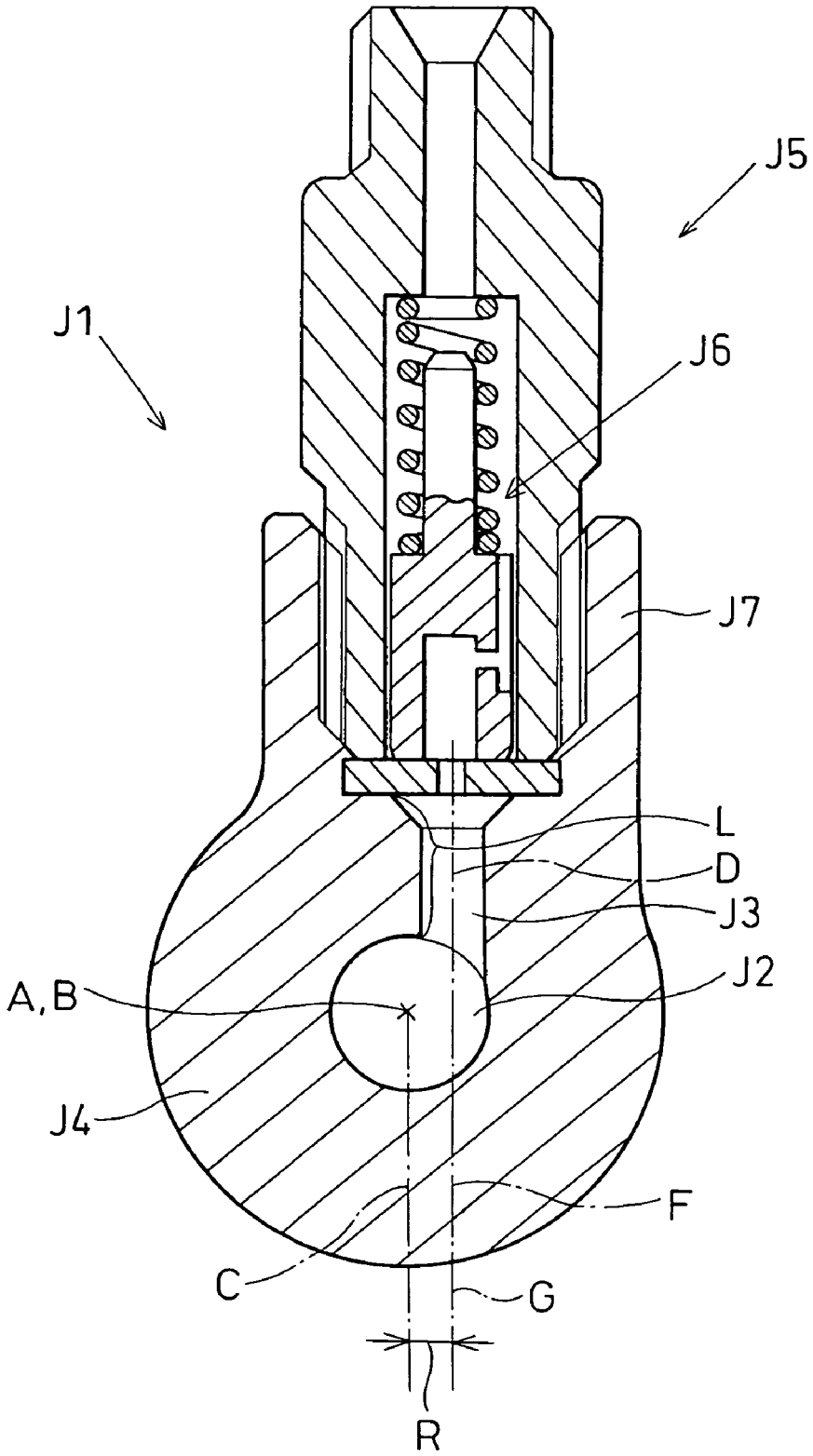
FIG. 5 PRIOR ART
FIG. 5 is a cross sectional view of a common rail in another prior art.

A common rail type fuel injection system is shown in FIG. 2. This system is for injecting fuel to each cylinder of an engine 100, and is composed of a common rail 1, injectors 2, a supply pump 3, an ECU (Electronic Control Unit) 4, an EDU (Engine Driving Unit) 5 and so on.

The common rail 1 is a pressure accumulation vessel in which high-pressure fuel to be supplied to the injectors 2 is accumulated. The common rail 1 is connected via a high-pressure pump distribution pipe 6 to a discharge port of the supply pump 3 for feeding high-pressure fuel thereto through the high-pressure pump distribution pipe 6 so that common rail pressure corresponding to a fuel injection pressure is accumulated therein. A plurality of injector distribution pipes 7 is joined to the common rail 1 for supplying high-pressure fuel to the respective injectors 2.

A pressure limiter 10 is mounted in a relief pipe 9 through which the fuel is returned from the common rail 1 to a fuel tank 8. The pressure limiter 10 is a pressure-safety valve which is opened when fuel pressure in the common rail 1 exceeds a predetermined value so that the fuel pressure in the common rail 1 is always kept below the predetermined value.

A pressure-reducing valve 11 is mounted on the common rail 1. The pressure-reducing valve 11 is opened upon receiving a valve opening instruction signal from the ECU 4 so that the common rail pressure is quickly reduced through the relief pipe 9. With the pressure-reducing valve 11 mounted on the common rail 1, the ECU 4 can control the common rail pressure to be quickly reduced to a pressure responsive to each vehicle running conditions.

Each of the injectors 2 is installed in each of cylinders of the engine for injecting fuel to the each of cylinders and connected to each downstream end of the injector distribution pipes 7 which are branched out of the common rail 1. The injector 2 has a fuel injection nozzle for supplying to the cylinder of the engine high-pressure fuel accumulated in the common rail 1 and an electromagnetic valve in which a lift of a needle accommodated in the fuel injection nozzle is controlled. Excess fuel in the injectors 2 is returned to the fuel tank 8 via the relief pipe 9.

The supply pump 3 is for feeding the fuel under high-pressure to the common rail 1. The supply pump 3 includes a feed pump, through which fuel in the fuel tank 8 is sucked via a filter 12. The supply pump 3 pressurizes the fuel sucked by the feed pump and the high-pressure fuel is delivered to the common rail 1. The feed pump and the supply pump 3 are driven by a camshaft 13. The camshaft 13 is rotatably driven by the engine.

In the supply pump 3, a SCV (Suction Control Valve) 14 is installed in a fuel passage through which the fuel is delivered to a pressure chamber for highly pressurizing fuel. Upon receiving a pump-driving signal from the ECU 4, the SCV 14 is controlled to adjust an amount of fuel to be sucked to the pressure chamber so that a discharge amount of the fuel to be delivered under high-pressure to the common rail 1 is adjusted. The ECU 4 controls the SCV 14 in such a manner that the common rail pressure is regulated to pressures responsive to vehicle running conditions.

The ECU 4 has components such as a CPU, a RAM and a ROM, and executes various calculation processing based on programs memorized in the ROM and signals sent from sensors (vehicle driving condition signals) read in the RAM. The ECU 4 executes, for example, the calculation processing for determining a target injection amount, an injection pattern and the valve opening-closing timings of each of the injectors 2 applicable to each of the cylinders based on the programs memorized in ROM and the signals sent from sensors (vehicle driving condition signals) read in the RAM.

The EDU 5 is a driving circuit which supplies the valve opening current to each electromagnetic valve of the injectors 2 based on the injector valve-opening signals sent from the ECU 4. As soon as the valve-opening current is supplied to the electromagnetic valve, a high-pressure fuel injection to each of the cylinders 2 starts. The high-pressure fuel injection terminates when the valve-opening current to the electromagnetic valve is stopped.

The ECU 4 is connected to and receives signals from various sensors, which are means for detecting vehicle driving conditions, such as a pressure sensor 15 for detecting the common rail pressure, an acceleration sensor for detecting an opening degree of a throttle valve, a revolution sensor for detecting an engine revolution frequency and a temperature sensor for detecting a temperature of an engine coolant.

The common rail 1 is provided with a pipe-shaped cylindrical body 20 in which high-pressure fuel is accumulated, a pipe-joining units 21 to which various distribution pipes such as the high-pressure pump distribution pipe 6 and the injector distribution pipes 7 are joined, and mounting bases 22 to which various functional parts such as the pressure limiter 10, the pressure reducing valve 11 and the pressure sensor 15 are mounted. The pipe-joining units 21 and the mounting bases 22 are provided on the cylindrical body 20.

Figure 1:
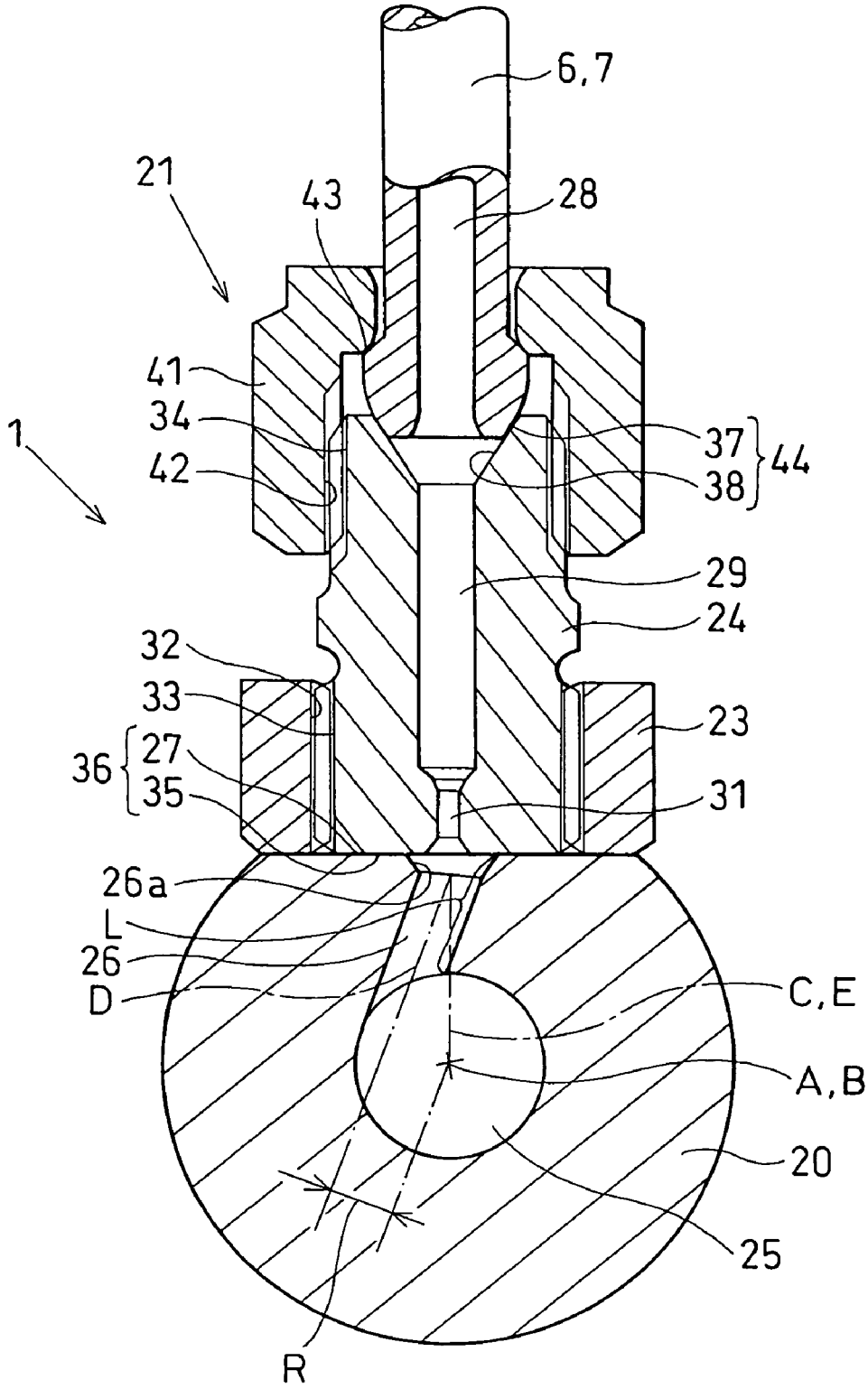
FIG. 1 is a cross sectional view of a common rail in accordance with the first embodiment of present invention.

As shown in FIG. 1, the cylindrical body 20 is formed by forging and provided with a chamber 25, delivery ports 26 and a first flat surface 27. However, the cylindrical body 20 may be formed with a standardized pipe on which the pipe-joining units 21 are axially arranged. In this case, the cylindrical body 20 can be manufactured at lower cost.

Each of the pipe-joining units 21 is provided with a joint fitter 23 fixed to the cylindrical body 20 by welding and a pipe joiner 24 screw-fastened and fixed to the joint fitter 23. Each of the distribution pipes such as the high-pressure pump distribution pipe 6 and the injector distribution pipes 7 is connected to the pipe joiner 24.

The cylindrical body 20 is provided with an axially-extending central chamber 25 for accumulating the high-pressure fuel, with a plurality of delivery ports 26 extending substantially in a radial direction and axially spaced at given intervals at a circumferential wall thereof, and with first flat surfaces 27 at an outer circumference thereof. The end of each of the delivery ports 26 is opened to the chamber 25 at the inner circumference of the cylindrical body 20, and another end thereof is opened to each of the first flat surface 27 at the center thereof. The delivery port 26 extends from the chamber 25 substantially tangentially toward the first flat surface 27. The opening circumferences of the delivery ports 26 are chamfered. The chamfers 26*a* provided with the opening circumferences of the delivery ports 26 makes the opening area of the delivery port large on the first flat surface 27.

The pipe joiner 24 is provided along the longitudinal center axis thereof with a fluid passage 29 which communicates the delivery port 26 with the conduit 28 of the distribution pipes 6, 7. The pipe joiner 24 is also provided with an orifice 31 for reducing the fluid flow pulsation generating in the distribution pipe 6, 7 in the fluid passage 29.

It is noted that the delivery port 26 is skewed relative to the fluid passage 29. It is not necessary to provide the orifice 31 in the cylindrical body 20 by providing the pipe joiner 24 with the orifice 31. It is not always necessary to provide the orifice 31 in the fluid passage 29 of the pipe joiner 24 to which the high-pressure pump distribution pipe 6 is joined.

The joint fitter 23 is formed in a ring shape whose inner diameter is larger than the inner diameter of the delivery port 26. A first screw 32 (with female screw thread) is formed on an inner circumferential wall of the joint fitter 23. The joint fitter 23 is bonded by resistance welding onto the first flat surface 27 of the cylindrical body 20, in a manner that the ring center of the joint fitter 23 and the outlet part of the delivery port 26 are positioned in a roughly coaxial alignment. Other bonding means may be adopted (such as wax bonding).

The pipe joiner 24 is provided at the side of one axial end thereof with a first male screw 33 screw-fastened to the first female screw 32 of the joint fitter 23, and at the side of the other axial end thereof with a second male screw 34.

The first male screw 33 is provided at an axial end thereof with a second flat surface 35 surrounding entirely an opening periphery of the fluid passage 29 and in contact with the first flat surface 27 of the cylindrical body 20.

The axial end of the first male screw 33 is inserted deep into the second female screw 32 by screwing the first male screw 33 into the first female screw 33, and the fluid passage 29 opening to the second flat surface 35 is communicated with the delivery port 26 opening to the first flat surface 27. The second flat surface 35 surrounding the fluid passage 29 is pressed against and in contact with the first flat surface 27 around the delivery port 26 to form a body-sealing surface (a fluid-tight sealing surface) 37 therebetween.

The second male screw 34 is provided at an axial end thereof with a conical pressure-receiving seat 38 against which a conical portion 37 formed at an end of each distribution pipe 6, 7 is pressed. The fluid passage 29 opens to a bottom of the pressure-receiving seat 39.

A second female screw 42 provided on an inner circumference of a pipe-mounting nut 41 is screw-fastened to the second male screw 34. The pipe mounting nut 41 is screwed into the second male screw 34 in a state that the pipe mounting nut 41 abuts against a step portion 43 at a back of the conical portion 37, so that the conical portion 38 of the distribution pipe 6, 7 is pressed against and in contact with the pressure-receiving seat 38 to form a pipe sealing surface (a fluid-tight pipe sealing surface) 44 therebetween.

According to the pipe-joining units 21, the body sealing surface (a fluid-tight sealing surface) 36 is formed by pressing the second flat surface 35 around the fluid passage 29 against the first flat surface 27 around the delivery port 26 in the state that the fluid passage 29 communicates with the delivery port 26, by screwing and inserting the first male screw 33 of the pipe joiner 24 deep into the first female screw 32 of the joint fitter 23.

The structure of the body-sealing surface 36 on the cylindrical body 20 is formed by pressing the second flat surface 35 of the joint fitter 24 against the first flat surface 27 of the cylindrical body 20. Accordingly, even if the mounting position of the joint fitter 23 is slightly shifted, the body sealing surface 36 can be assured without fail.

The pipe-joining unit 21 has the following advantages.

(1) Since higher dimensional accuracy of the joint fitter 23 and the cylindrical body 20 is not required, each manufacturing cost of the joint fitter 23 and the cylindrical body 20 is reduced.

(2) Since it is not required that the mounting position of the joint fitter 23 on the cylindrical body 20 is controlled with higher accuracy, the joint fitter 23 can be bonded to the cylindrical body 20 by inexpensive bonding means such as resistance welding without using the expensive laser welding. Accordingly, the cost of bonding the joint fitter 23 to the cylindrical body 20 is reduced.

(3) It is preferable that the cylindrical body 20, which has to endure high pressure, is made of material having higher hardness such as middle or high carbon steel. The middle or high carbon steel can be bonded by inexpensive bonding means such as resistance welding but cannot be bonded by the expensive laser welding. Since the joint fitter 23 can be bonded by the resistance welding to the cylindrical body 20 made of middle or high carbon steel having extremely high-pressure durability, more compact body size of the cylindrical body 20 can be achieved.

(4) Into the joint fitter 23 is inserted only the pipe joiner 24 and no other member (such as the distribution pipes or the distribution pipe extension cylinders), so that a smaller screw size can be employed for the joint fitter 23. This improves the mountability onto the vehicles thereof.

Further, the opening edges of the delivery ports 26 have chamfers 26*a* so that the area of the opening area of the delivery ports 26 on the outer circumference is enlarged. By adopting the chamfer 26*a*, even if the mounting position of the joint fitter 23 to the cylindrical body 20 is slightly shifted, the fuel passage 29 in the pipe joiner 24 communicates with the outer opening of the delivery port 26 without fail.

Accordingly, the mounting position of the joint fitter 23 onto the cylindrical body 20 may not be highly accurate, so that the productivity of the pipe-joining unit 21 is improved.

Here, the longitudinal center axis A of the chamber 25 is positioned on the center B of the circumferential cylinder of the cylindrical body 20.

The longitudinal center axis D of the delivery port is inclined to the radial line E passing through the center B of the circumferential cylinder of the cylindrical body 20 and the outer opening center of the delivery port 26.

To provide common rail 1 with the fuel injection system has the following advantages.

(1) Each of the delivery ports 26 is disposed with inclination to the radius of the circumferential cylinder of the cylindrical body 20, so that the inner opening of each of the delivery ports 26 is shaped as an oval and the stress concentrating around the inner opening circumference is reduced and the durability of the cylindrical body 20 is improved.

(2) The longitudinal center axis A of the chamber 25 is positioned on the center B of the circumferential cylinder of the cylindrical body 20, so that the chamber 25 and the circumferential wall of the cylindrical body 20 can be formed by rotating the cylindrical body. Thus the limitation in processing the cylindrical body 20 is reduced and the productivity is improved.

(3) The longitudinal center axis A of the chamber 25 is positioned on the center "B" of the circumferential cylinder of the cylindrical body 20, so that the thickness of the circumferential wall of the cylindrical body 20 is uniformed. Accordingly, the heat caused by welding the joint fitter 23 onto the cylindrical body 20 does not cause distortion in the cylindrical body 20.

(4) Each of the delivery ports 26 is disposed with inclination to the radius of the circumferential cylinder of the cylindrical body 20, so that the length of the delivery port 26 (especially the shortest length L of the inner circumference along the longitudinal center axis thereof) is extended. The cylindrical body 20 endures against a tensile strength generated along the circumference thereof by the high-pressure fuel accumulated in the chamber 25. Accordingly, the tensile stress concentrating around the delivery port 26 is lowered by the extension of the shortest length L of the delivery port 26. And the durability of the cylindrical body 20 around the delivery port 26 is improved.

(5) Each of the delivery ports 26 is disposed with inclination to the radius of the circumferential cylinder of the cylindrical body 20, so that the fuel in the chamber 25 is given a rotating flow which serves to reduce the fluid flow pulsation occurring in the distribution pipe 6, 7.

Second Embodiment

The second embodiment is described with reference to the cross sectional view of the common rail 1 shown in FIG. 3.

The common rail 1 in the second embodiment has a pipe-joining unit 21 whose joint fitter 23 is formed in a same body with the cylindrical body 20 by forging. Similar to the first embodiment, the longitudinal center axis A of the chamber 25 is positioned on the center of the circumferential cylinder of the cylindrical body 20. The outer opening of each of the delivery ports 26 is centered on each radial line C of the circumferential cylinder of the cylindrical body 20 passing through the center B thereof.

Further, the longitudinal center axis D of the delivery port 26 is inclined to a radius E of the circumferential cylinder of the cylindrical body 20 which passes through the center B of the circumferential cylinder of the cylindrical body 20.

By providing the common rail 1 in the fuel injection system, the same advantages as that of the first embodiment are derived.

In manufacturing the cylindrical body 20, the die parting plane G can be set on the radial line E of the circumferential cylinder of the cylindrical body 20 which passes through the opening center of the delivery port 26 and the center B of the circumferential cylinder of the cylindrical body, so that the forging dies of the cylindrical body 20 are symmetric which are easily manufactured, this makes the manufacturing the cylindrical body 20 easier. The forging die shaped simple extends the life thereof.

Further, the pipe-joining unit 21 in the second embodiment is to connect the injector distribution pipe 7, and provided with a resistance-adjusting valve 51 in the pipe joiner 24.

The flow resistance-adjusting valve 51 comprises a valve 52 disposed in a fluid chamber 29*a* provided in the pipe joiner 24 in which the fuel passes through, and a spring 53 which pushes the valve 52 onto a plate 54.

The valve 52 is provided with a fuel passage 52*a* which communicates the wide-diameter orifice 31*a* (communicating with the delivery port 26) and the fluid chamber 29*a*. In the fuel passage 52*a* is provided a narrow-diameter orifice 31*a*.

The resistance-adjusting valve 51 adjusts the sectional area for the fuel flow by the opening degree of the valve 52, which opens and closes according to the speed of the fuel flow toward the injector distribution pipe 7.

Further, the plate 54 sandwiched between the cylindrical body 20 and the pipe joiner 24 in the pipe-joining unit 21 in the second embodiment also serves as a packing body. The plate 54 is provided with the wide-diameter orifice 31*a* which communicates the interior of the delivery port 26 and the fluid chamber 29*a* (that is, fuel passage 52*a* in the valve 52).

The resistance-adjusting valve 51 is not necessary by alternating the wide-diameter orifice 31*a* with the orifice 31 in the first embodiment. By providing the orifice 31 in the plate 54 makes the manufacturing of the orifice 31 easier, and the productivity is improved.

Thus, by providing the plate 54 which also serves as a packing body between the cylindrical body 20 and the pipe joiner 24, the contact quality of the first and the second flat surfaces 27, 35 may not be strictly accurate, and the assembling cost is reduced.

What is claimed is:

1. A common rail for an engine comprising:

a cylindrical body provided with a chamber for accumulating highly pressured fuel and a delivery port which connects the chamber to an outer circumference thereof, and a pipe-joining unit which communicates the delivery port and a conduit in a distribution pipe connected to an injector; and wherein a longitudinal center axis of the pipe-joining unit and a longitudinal center axis of the cylindrical body intersect with each other, a longitudinal center axis of the delivery port and a longitudinal center axis of the cylindrical body are in a skew relation, a whole of one longitudinal end of the delivery port opens to the chamber, and an opening circumference of the delivery port that opens on the outer circumference of the cylindrical body is chamfered.

2. A common rail according to claim 1, wherein a longitudinal center axes of the chamber and the cylindrical body are disposed substantially coaxially with each other.

3. A common rail according to claim 1, wherein the pipe-joining unit includes:

a joint fitter fixed onto the outer circumference of the cylindrical body to surround an opening of the delivery port and provided with a first female screw; and a pipe joiner with a first and a second male screws at each side of one and the other axial end thereof and joined to the cylindrical body by screw-fastening the first male screw into the first female screw; and wherein the conduit in the distribution pipe communicates via a fluid passage provided in the pipe joiner with the delivery port by screw-fastening the second male screw to a second female screw provided in a pipe fastening screw engaged with the distribution pipe.

4. A common rail according to claim 3, wherein:

the joint fitter is fixed onto a first flat surface provided around a delivery port opening on the outer circumference of the cylindrical body;

a second flat surface is provided at an axial end of the first male screw; and the first male screw is screw-fastened into the first female screw so that the second flat surface is pressed onto the first flat surface and a fluid-tight sealing between the cylindrical body and the pipe joiner is formed.

5. A common rail for supplying pressured fuel to an engine through a distribution pipe and an injector, the common rail comprising:

a cylindrical body provided with a chamber for accumulating highly pressured fuel and a delivery port which connects the chamber to an outer circumference thereof, wherein a longitudinal center axis of the delivery port crosses a circumferential surface of the cylindrical body at an inclined angle, a tip of one longitudinal end of the delivery port is on a circumferential face of the chamber, and an imaginary straight line intersecting a radial center of the chamber extends through and along the delivery port within an inner surface thereof.

6. A common rail according to claim 5, wherein the longitudinal center axis of the delivery port is in a plane perpendicular to a longitudinal axis of the cylindrical body.

7. A common rail according to claim 5, further comprising:

a joint fitter fixed onto the outer circumference of the cylindrical body to surround an opening of another longitudinal end of the delivery port for connecting the distribution pipe to the cylindrical body, wherein a longitudinal center axis of the joint fitter intersects a radial center of the chamber.

8. A common rail according to claim 7, wherein the joint fitter is formed in a same body with the cylindrical body.

9. A common rail according to claim 7, wherein:

the cylindrical body has a flat surface provided on the outer circumference thereof onto which the joint fitter is fixed; and the longitudinal center axis of the delivery port crosses the flat surface substantially on the longitudinal center axis of the joint fitter.

10. A common rail according to claim 7, further comprising:

a pipe joiner screw-fastened at one axial end thereof to the joint fitter and at the other axial end thereof to the distribution pipe, and provided with a fluid passage through which the delivery port and a conduit of the distribution pipe communicate with each other, wherein longitudinal center axes of the fluid passage and the joint fitter are disposed substantially coaxially with each other.

11. A common rail according to claim 10, further comprising:

a plate with an orifice sandwiched between the cylindrical body and the pipe joiner in the fluid passage, wherein the pipe joiner is screw-fastened into the joint fitter so that the pipe joiner is pressed via the plate onto the cylindrical body and a fluid-tight sealing between the cylindrical body and the pipe joiner is formed.

12. A common rail for supplying pressured fuel to an engine through a distribution pipe and an injector, the common rail comprising:

a cylindrical body having an accumulation chamber extending in a longitudinal direction for accumulating pressured fuel therein, the cylindrical body further having a delivery port communicated with the accumulating chamber at one longitudinal end thereof and extending in a tangential relation to the accumulation chamber so that a whole of one longitudinal end is on a circumferential face of the accumulation chamber;

a pipe-joining unit having a fluid passage for supplying the pressured fuel in the accumulation chamber to the distribution pipe, the fluid passage extending in a perpendicular relation to the accumulation chamber and connected to another end of the delivery port; and an opening circumference of the another end of the delivery port that opens on an outer circumference of the cylindrical body is chamfered, wherein a longitudinal center axis of the fluid passage intersects a radial center of the accumulation chamber.

13. A common rail according to claim 12, wherein:

the cylindrical body has the accumulation chamber in a radial center thereof and a flat surface on a circumference thereof;

the another end of the delivery port is provided in a center of the flat surface in a direction perpendicular to the fluid passage; and the pipe-joining unit is thread-engaged with the cylindrical body to contact the flat surface.

14. A common rail according to claim 1, further comprising a flow damper located in the pipe-joining unit.

15. A common rail according to claim 10, further comprising a flow damper located in the pipe joiner.

16. A common rail according to claim 12, further comprising a flow damper located in the pipe-joining unit.

17. A common rail according to claim 11, wherein an opening circumference of said another longitudinal end of the delivery port is chamfered.

18. A common rail according to claim 3, further comprising:

a plate with an orifice sandwiched between the cylindrical body and the pipe joiner in the fluid passage, wherein the joint fitter is fixed onto a first flat surface provided around a delivery port opening on the outer circumference of the cylindrical body, a second flat surface is provided at an axial end of the first flat male screw, the first male screw is screw-fastened into the first female screw so that the first and the second flat surfaces are pressed onto both faces of the plate and fluid-tight sealings between the cylindrical body and the plate and between the pipe joiner and the plate are formed.

19. A common rail according to claim 12, further comprising:

a plate with an orifice sandwiched between the cylindrical body and the pipe joiner in the fluid passage, wherein the pipe-joining unit is thread-engaged with the cylindrical body so that one end surface of the pipe-joining unit and an outer circumferential surface of the cylindrical body are pressed onto both faces of the plate and fluid-tight sealings between the cylindrical body and the plate and between the pipe-joining unit and the plate are formed.

20. A common rail according to claim 1, wherein an imaginary straight line extends through and along both a fluid passage bore provided in the pipe-joining unit and the delivery port within an inner surface thereof.

21. A common rail according to claim 12, wherein an imaginary straight line extends through and along both a fluid passage bore provided in the pipe-joining unit and the delivery port within an inner surface thereof.

* * * * *